US011043065B2

(12) United States Patent
McNierney et al.

(10) Patent No.: US 11,043,065 B2
(45) Date of Patent: Jun. 22, 2021

(54) ELECTRONIC GAMING MACHINE INCLUDING MONITOR ARTICULATION MECHANISM

(71) Applicant: ARISTOCRAT TECHNOLOGIES AUSTRALIA PTY LIMITED, North Ryde (AU)

(72) Inventors: James McNierney, Las Vegas, NV (US); Kiran Uthamanthil Kizhakkeveedu, Atlanta, GA (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 100 days.

(21) Appl. No.: 16/578,983

(22) Filed: Sep. 23, 2019

(65) Prior Publication Data

US 2021/0090382 A1 Mar. 25, 2021

(51) Int. Cl.
*G07F 17/32* (2006.01)

(52) U.S. Cl.
CPC ..... *G07F 17/3216* (2013.01); *G07F 17/3213* (2013.01); *G07F 17/3223* (2013.01)

(58) Field of Classification Search
USPC ..... 463/46
See application file for complete search history.

(56) References Cited

U.S. PATENT DOCUMENTS

| | | | | |
|---|---|---|---|---|
| 4,440,457 | A * | 4/1984 | Fogelman | A63F 13/08 463/46 |
| 7,758,429 | B2 | 7/2010 | Crivelli et al. | |
| 9,881,443 | B2 | 1/2018 | Maher et al. | |
| 10,181,236 | B2 * | 1/2019 | Goldstein | G07F 17/3216 |
| 10,520,977 | B2 | 12/2019 | Mittler | |
| 2008/0113821 | A1 | 5/2008 | Beadell et al. | |
| 2009/0221375 | A1 | 9/2009 | Luciano et al. | |
| 2018/0053373 | A1 * | 2/2018 | Goldstein | G07F 17/3216 |

* cited by examiner

*Primary Examiner* — Pierre E Elisca
(74) *Attorney, Agent, or Firm* — Armstrong Teasdale LLP

(57) ABSTRACT

An electronic gaming machine includes a cabinet defining an internal compartment and an access opening that provides access to the internal compartment, a monitor positioned within the access opening, and an articulating support frame positioned within the internal compartment and operatively coupled to the monitor. The monitor is moveable by the articulating support frame along a first, linear path of motion from a first, closed position to a second, intermediate position, and along a second, arcuate path of motion from the second position to a third, open position.

20 Claims, 13 Drawing Sheets

ELECTRONIC GAMING MACHINE INCLUDING MONITOR ARTICULATION MECHANISM

TECHNICAL FIELD

The field of disclosure relates generally to electronic gaming, and more particularly, to electronic gaming machines including a monitor articulation mechanism.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Video-based games generally use one or more display screens to display gaming symbols to a player during game play.

Some gaming machines utilize two or more display screens or monitors, for example, to provide different display screens for different modes of game play (e.g., base game play and bonus or feature game play), or to create a larger display screen. In at least some such gaming machines, access to the gaming machine cabinet may be provided by rotating or otherwise moving one or more of the monitors from a first, closed position to a second, open position to provide access to an opening in the gaming machine cabinet. As the design of multiple-monitor gaming devices evolves, improved monitor articulation mechanisms are needed to allow monitors to be moved to provide access to the gaming machine cabinet, without interfering with or being obstructed by surrounding components of the gaming machine, such as adjacent monitors, panels, etc.

BRIEF DESCRIPTION

In one aspect, an electronic gaming machine includes a cabinet defining an internal compartment and an access opening that provides access to the internal compartment, a monitor positioned within the access opening, and an articulating support frame positioned within the internal compartment and operatively coupled to the monitor. The monitor is moveable by the articulating support frame along a first, linear path of motion from a first, closed position to a second, intermediate position, and along a second, arcuate path of motion from the second position to a third, open position.

In another aspect, a method includes providing an electronic gaming machine that includes a cabinet defining an internal compartment and an access opening, a monitor positioned within the access opening, and an articulating support frame positioned within the internal compartment and operatively coupled to the monitor. The method further includes moving the monitor, by the articulating support frame, along a first, linear path of motion from a first, closed position to a second, intermediate position, and moving the monitor, by the articulating support frame, along a second, arcuate path of motion from the second position to a third, open position in which the monitor permits access to the internal compartment through the access opening.

In yet another aspect, an articulating support frame for a monitor of an electronic gaming machine is provided. The articulating support frame includes a linear guide having a proximal end configured for fixedly coupling to a cabinet of the electronic gaming machine, and a distal end configured for linear movement towards and away from the proximal end. The articulating support frame further includes a monitor mounting frame pivotably coupled to the linear guide at the distal end thereof. The articulating support frame is configured to move the monitor along a first, linear path of motion from a first, closed position to a second, intermediate position, and along a second, arcuate path of motion from the second position to a third, open position.

BRIEF DESCRIPTION OF THE DRAWINGS

An example embodiment of the subject matter disclosed will now be described with reference to the accompanying drawings.

DETAILED DESCRIPTION

Embodiments of the present disclosure are directed to monitor articulation mechanisms and, in particular, articulating support frames for monitors of electronic gaming machines. Embodiments of the articulating support frames disclosed herein allow monitors of electronic gaming machines to be moved along a path of motion with multiple, discrete motion paths such that the monitor can be moved out of an access opening to provide access to an internal compartment of the electronic gaming machine, without interfering with adjacent components of the electronic gaming machine (e.g., adjacent monitors, light bars, etc.). The articulating support frames of the present disclosure thereby allow monitors of various configurations and arrangements (including, for example, multiple curved monitors positioned adjacent one another) to be used as an access door or panel to access the internal compartment of the electronic gaming machine.

Figure 1:
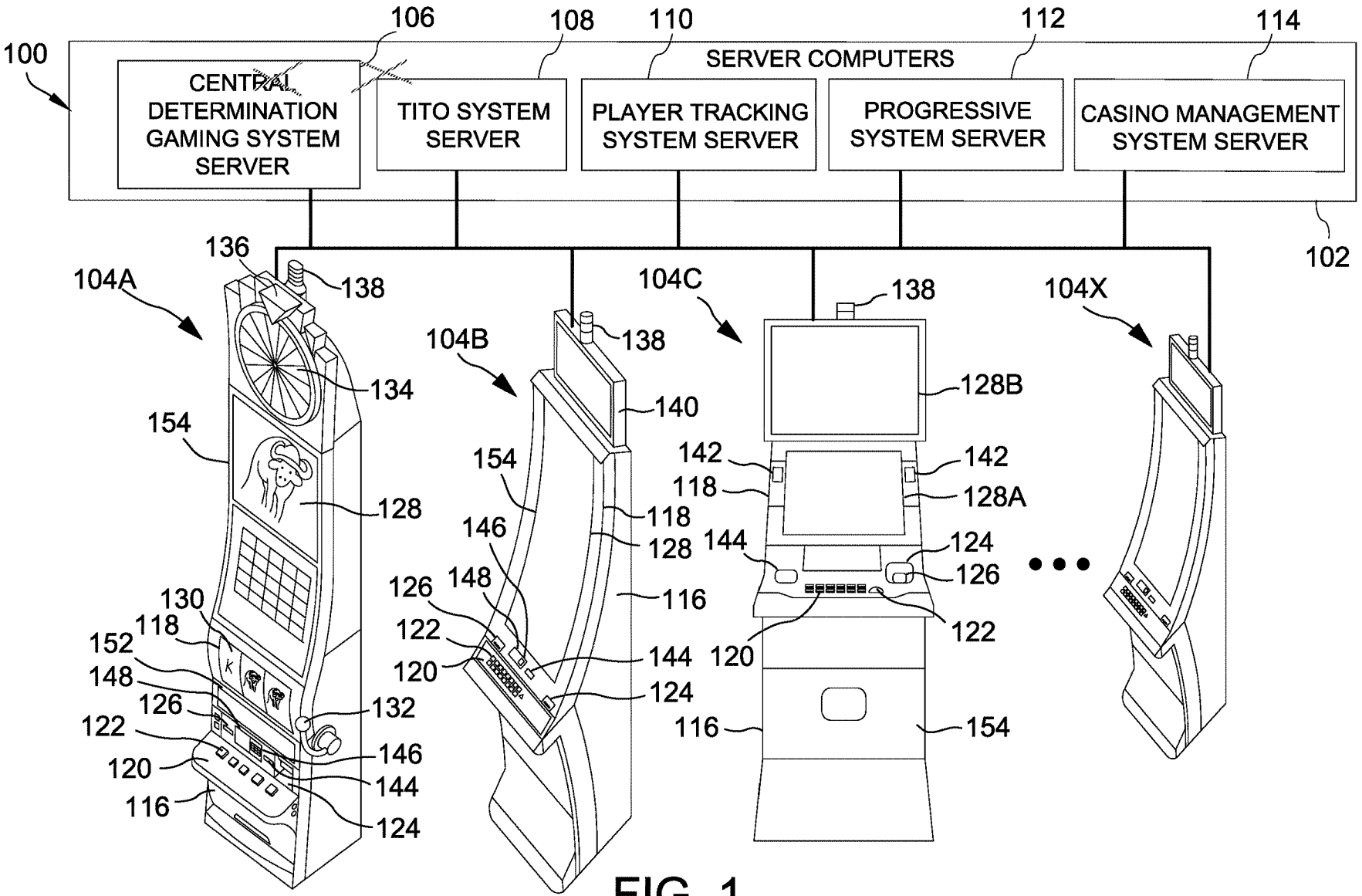
FIG. 1 is a schematic diagram of a plurality of EGMs networked with various gaming-related servers.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming machines or devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a web site maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes one or more access doors 154 which provide access to the interior of the cabinet. Access door 154 labelled on gaming device 104A in FIG. 1 is a top door, although it should be understood that gaming device 104A may include any suitable number and combination of access doors including, for example and without limitation, a main door, a top door, a drop door, a belly door, and/or a stacker door Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
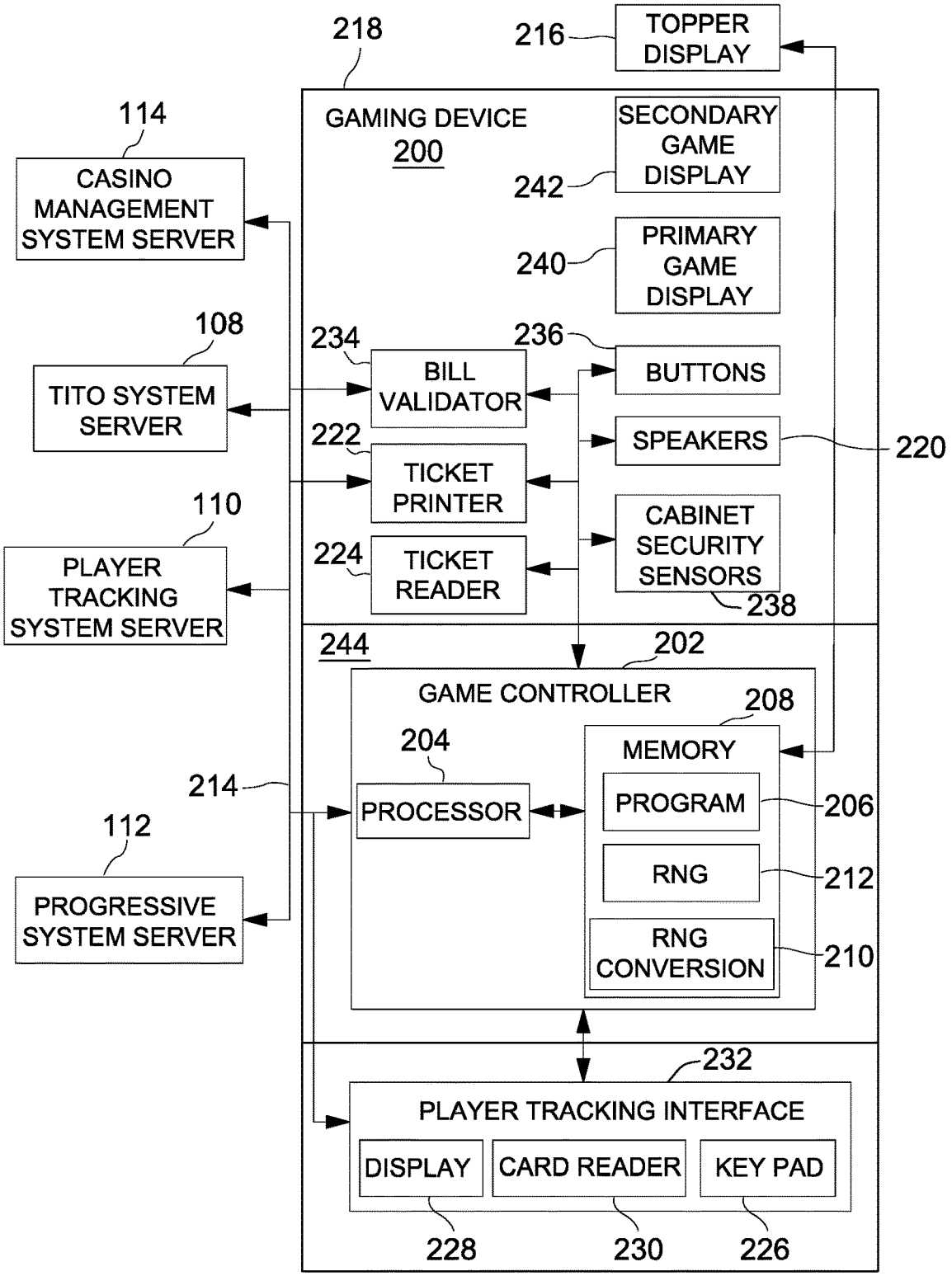
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including an access door 154 which opens to provide access to the interior of the gaming device 104B. The access door 154 is typically used by service personnel to refill the ticket-out printer 126 and collect bills and tickets inserted into the bill validator 124. The access door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2 illustrates that game controller 202 includes a single memory 208, game controller 202 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

The game controller 202, including the processor 204 and the memory 208, along with other components of the gaming device 200, are housed within an internal compartment 244 defined by the cabinet 218. Although only a single internal compartment 244 is shown in FIG. 2, it should be understood that the gaming device 200 may include more than a single internal compartment 244, and that other components than those shown in FIG. 2 may be housed within the internal compartments 244 of the gaming device 200. The internal compartment 244 may be accessible via an access door of cabinet 218 (e.g., access door 154, shown in FIG. 1).

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. Game developers could vary the degree of true randomness for each RNG (e.g., pseudorandom) and utilize specific RNGs depending on game requirements.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2 also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment.

The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 3:
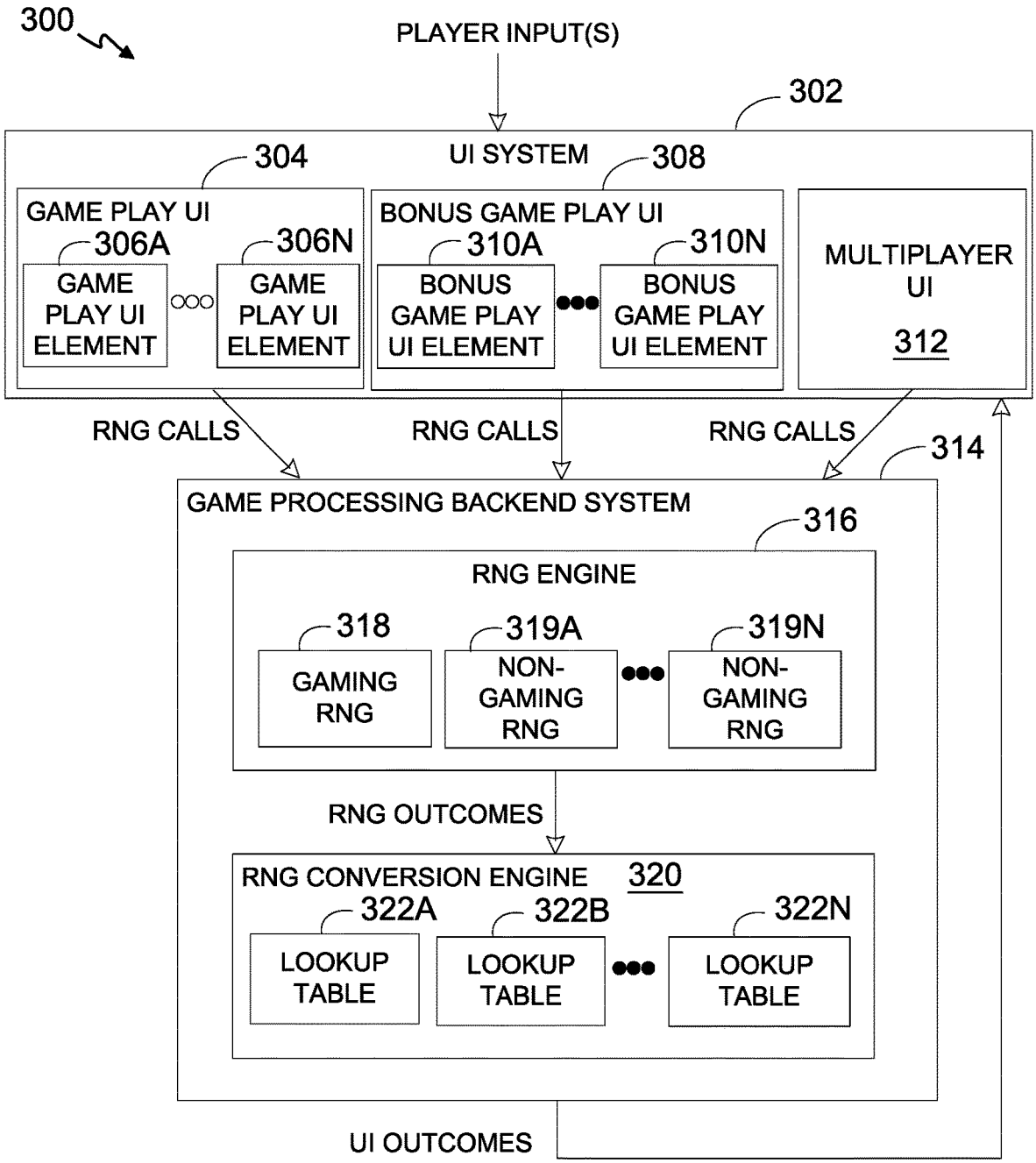
FIG. 3 illustrates, in block diagram form, an embodiment of a game processing architecture that implements a game processing pipeline for the play of a game in accordance with some embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from to the bonus game play UI elements 310A-310N.

FIG. 3 also illustrates that UI system 302 could include a multiplayer UI 312 purposed for game play that differ or is separate from the typical base game. For example, multiplayer UI 302 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computationally less expensive. Non-gaming RNGs 319A-319N can thus be used to generate outcomes for non-gaming purposes. As an example, non-gaming RNGs 319A-319N can generate random numbers for such as generating random messages that appear on the gaming device. The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome to the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

Figure 4:
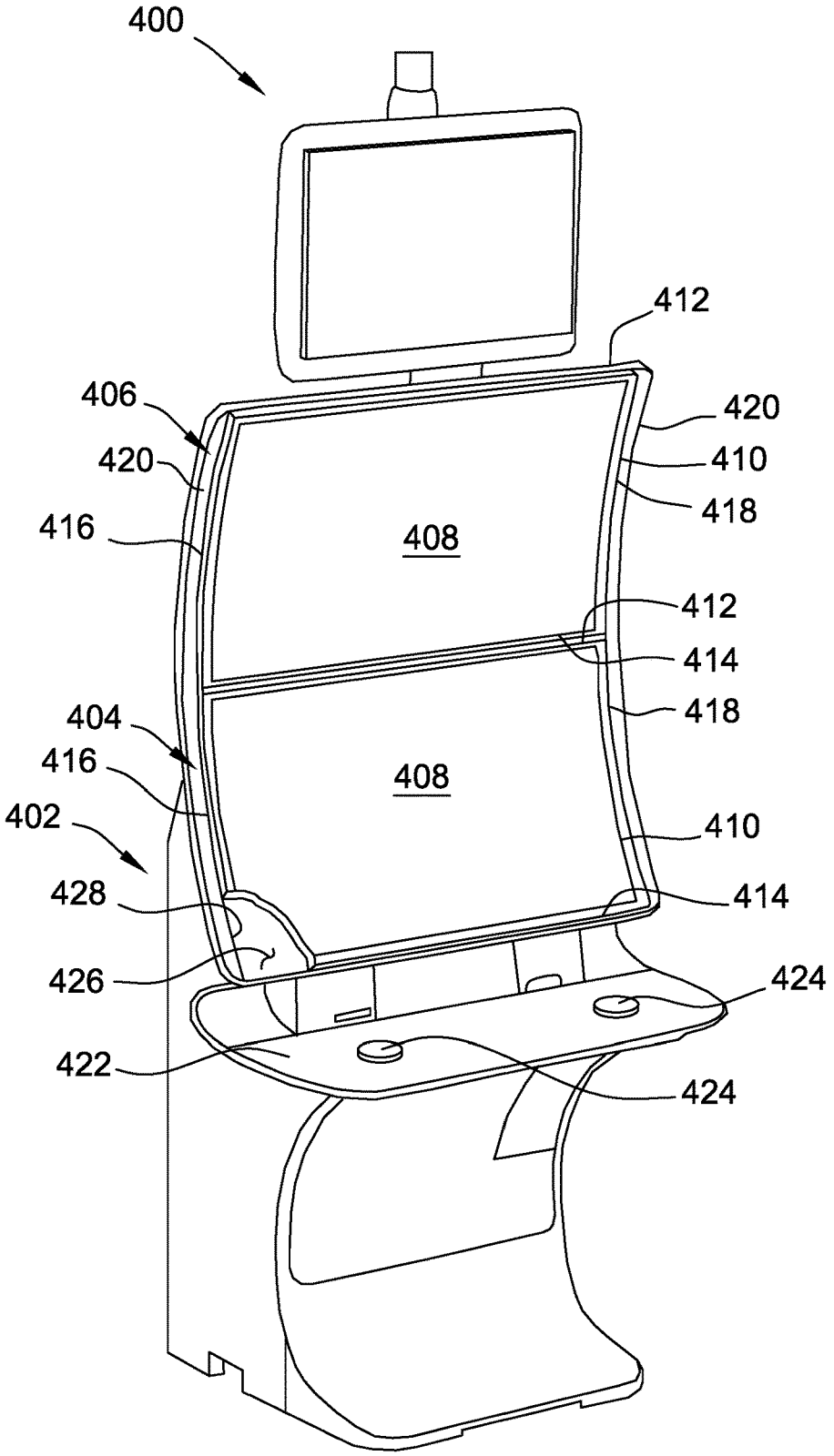
FIG. 4 is a perspective view of an exemplary EGM including a first display monitor and a second display monitor.

FIG. 4 is a perspective view of another exemplary gaming machine 400, shown as an EDGE X™ model gaming machine manufactured by Aristocrat® Technologies, Inc. All or parts of the example gaming devices 104A-X, 200 shown in FIGS. 1 and 2, respectively, could be implemented in gaming machine 400. In the exemplary embodiment, gaming machine 400 includes a cabinet 402 that houses electronic components or circuitry of gaming machine 400 (e.g., electronic components shown in FIG. 2), a first display monitor 404, and a second display monitor 406.

Each of first and second display monitors 404, 406 includes a display screen 408 and a housing 410 that houses or encloses electronic components of the display monitor. Each of first and second display monitors 404, 406 can be a high-resolution LCD, plasma, LED, or OLED panel which may be flat or curved as shown, a cathode ray tube, or other conventional electronically controlled video monitor. First and second display monitors 404, 406 also include respective top edges 412, bottom edges 414, and first and second side edges 416, 418 extending between top edge 412 and bottom 414. In the illustrated embodiment, each of the first display monitor 404 and the second display monitor 406 includes a curved display screen 408 that has a curvature radius from top edge 412 to bottom edge 414.

First and second display monitors 404, 406 are coupled to cabinet 402 in a vertically-stacked configuration in which the second display monitor 406 is positioned above and adjacent to first display monitor 404 such that bottom edge 414 of second display monitor 406 adjoins top edge 412 of first display monitor 404. First and second display monitors 404, 406 thereby cooperatively form a combined curved display screen, and adjoin one another along an edge (e.g., top edge 412 of first display monitor 404 and bottom edge of second display monitor 406) that intersects the curved display screen. In other embodiments, first display monitor 404 may be positioned above second display monitor 406. In yet other embodiments, first and second display monitors 404, 406 may be coupled to cabinet 402 in a horizontal configuration such that first and second display monitors 404, 406 adjoin one another along a vertical edge (e.g., first and second side edges 416, 418).

In the exemplary embodiment, first display monitor 404 is a main or primary display monitor typically used for primary game play, and second display monitor 406 is a secondary display monitor typically used for bonus game play, to show game features or attraction activities while the game is not in play or any other information or media desired by the game designer or operator. In other embodiments, second display monitor 406 may be used as the main or primary display monitor, and first display monitor 404 may be used as the secondary display monitor. In yet other embodiments, first display monitor 404 and second display monitor 406 may be used in combination with one another to display GUIs and graphics for both primary game play and bonus game play.

In the exemplary embodiment, gaming machine 400 also includes vertical light bars 420 positioned on opposite sides of first and second display monitors 404, 406. Gaming machine 400 may include other components of gaming devices 104A-104X and 200 shown in FIGS. 1 and 2, respectively. For example, gaming machine 400 includes a button area or button deck 422 that is configured with input switches or buttons 424.

In accordance with the present disclosure, one or both of first and second display monitors 404, 406 may be operable as an access door (e.g., access door 154) that provides access to an internal compartment 426 defined by cabinet 402. A portion of the first display monitor 404 is cut away in FIG. 4 to illustrate a portion of the internal compartment 426. In particular, one or both of first and second display monitors 404, 406 may be moveable from their respective closed positions shown in FIG. 4 to respective open positions in which first and second display monitors 404, 406 enable access to the internal compartment 426 through one or more access openings.

In the exemplary embodiment, first display monitor 404 is a moveable monitor, and is positioned within an access opening 428 of gaming machine 400. The access opening 428 is sized and shaped complementary to first display monitor 404 such that, when first display monitor 404 is in a closed position (shown in FIG. 4), first display monitor completely occludes access opening 428, and prevents access to internal compartment 426. In the illustrated embodiment, access opening 428 is defined, at least in part, by bottom edge 414 of second display monitor 406 and light bars 420. As described further herein, first display monitor 404 is operatively coupled to a monitor articulation mechanism that enables first display monitor 404 to be moved along a first, linear path of motion and, subsequently, along a second, arcuate path of motion such that first display monitor 404 can be moved out of access opening 428 without interfering with or being obstructed by surrounding components of gaming machine 400 (e.g., second display monitor 406 and light bars 420).

Figure 5:
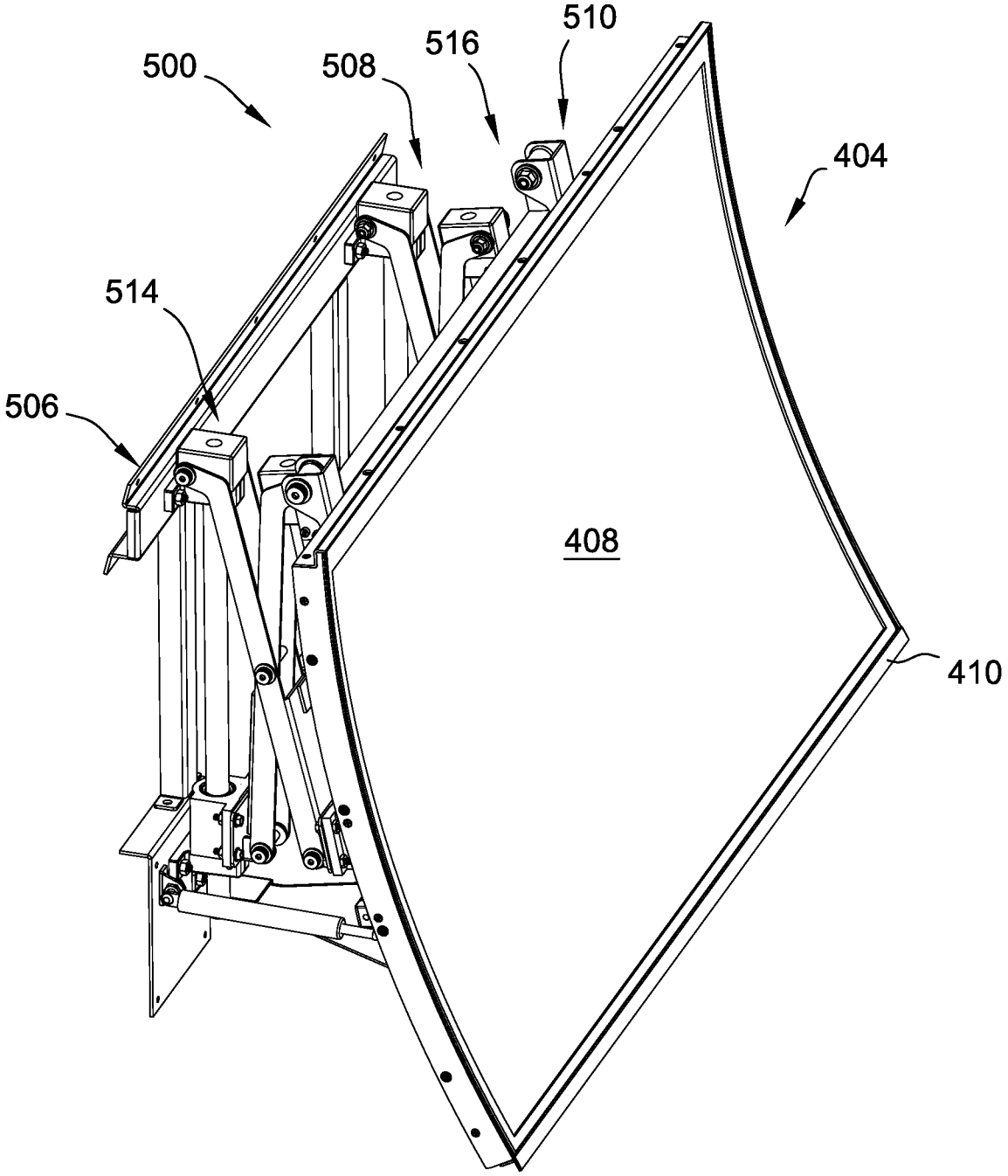
FIG. 5 is a perspective view of an exemplary monitor articulation mechanism coupled to the first display monitor and positioned within an internal compartment of the EGM shown in FIG. 4.
Figure 6:
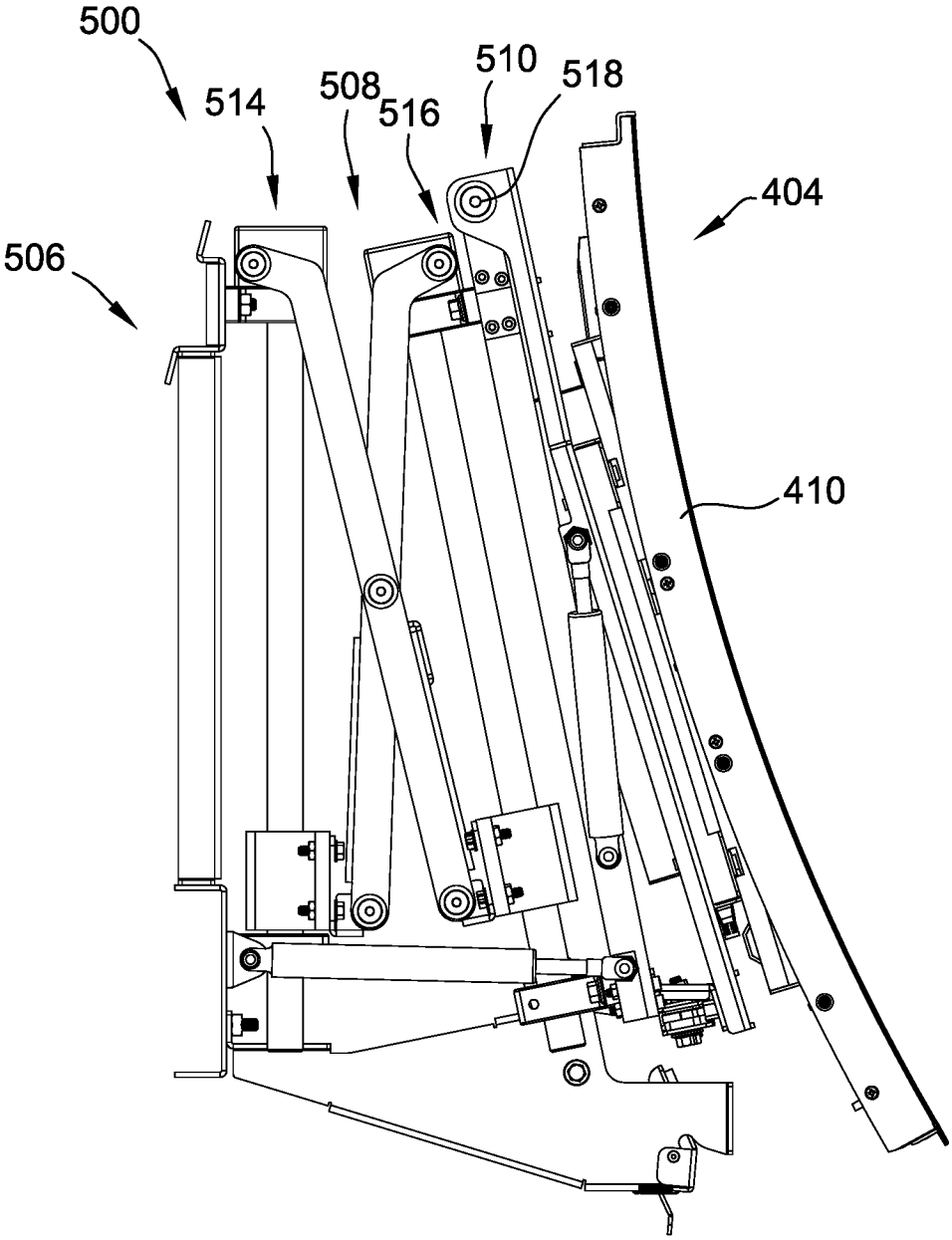
FIG. 6 is a side view of the monitor articulation mechanism and the first display monitor shown in FIG. 5, where the first display monitor is shown in a first, closed position.
Figure 7:
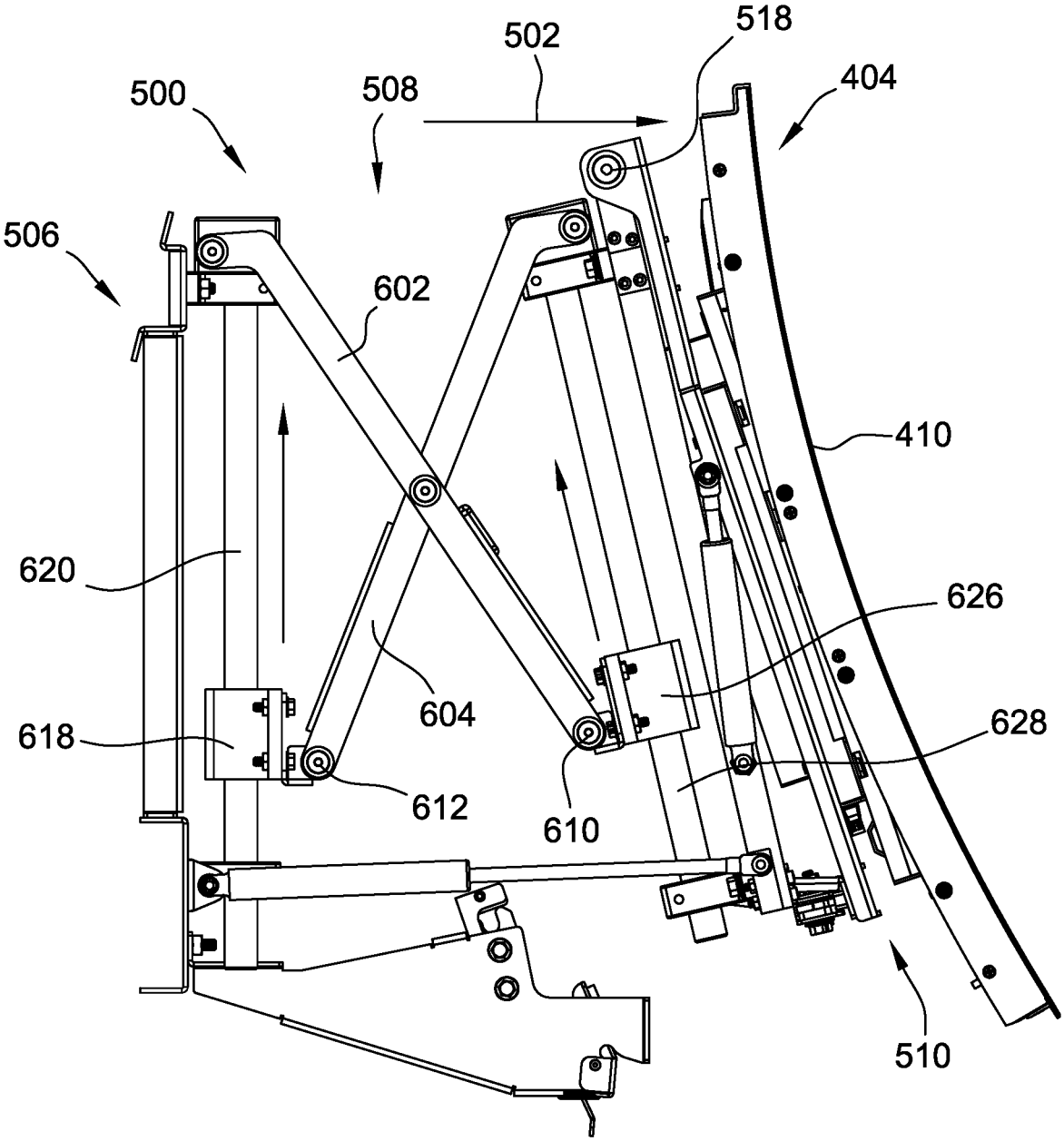
FIG. 7 is another side view of the monitor articulation mechanism and the first display monitor shown in FIG. 5, where the first display monitor is shown in a second, intermediate position.
Figure 8:
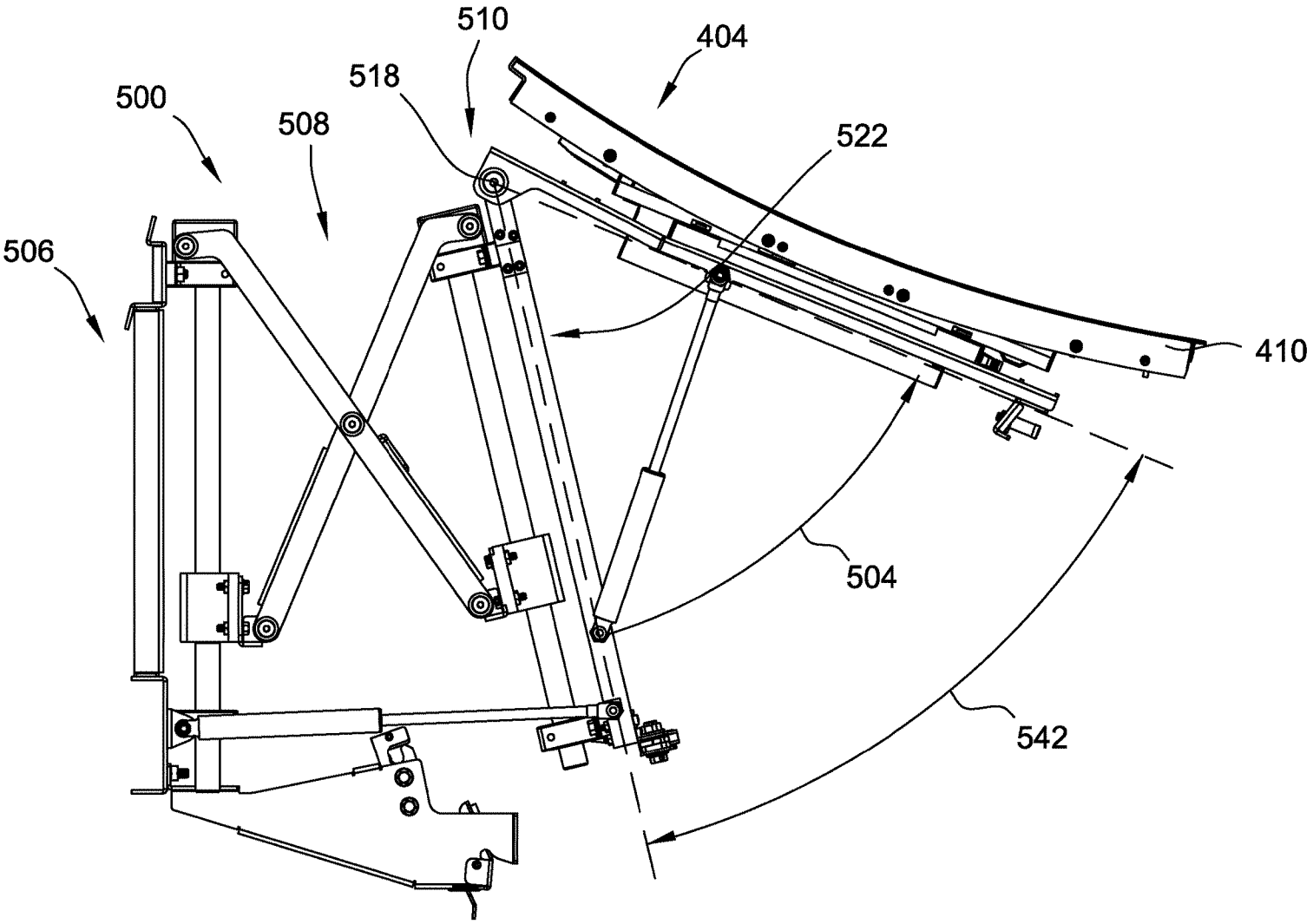
FIG. 8 is another side view of the monitor articulation mechanism and the first display monitor shown in FIG. 5, where the first display monitor is shown in a third, open position.

FIG. 5 is a perspective view of a monitor articulation mechanism, illustrated in the form of an articulating support frame 500, coupled to first display monitor 404. FIG. 6 is a side view of articulating support frame 500 coupled to first display monitor 404, and FIGS. 7 and 8 illustrate articulating support frame 500 moving first display monitor 404 along a first, linear path of motion (indicated by arrow 502 in FIG. 7) from a first, closed position (shown in FIGS. 4-6) to a second, intermediate position (shown in FIG. 7), and along a second, arcuate path of motion (indicated by arrow 504 in FIG. 8) from the second position to a third, open position (shown in FIG. 8) in which first display monitor 404 permits access to internal compartment 426 through access opening 428.

Articulating support frame 500 is positioned within internal compartment 426 of gaming machine 400, and is operatively coupled to first display monitor 404. In the exemplary embodiment, articulating support frame 500 includes a mounting frame assembly 506 for mounting articulating support frame 500 to cabinet 402, a linear guide 508 for moving first display monitor 404 along first, linear path of motion 502, and a monitor mounting frame 510.

Figure 9:
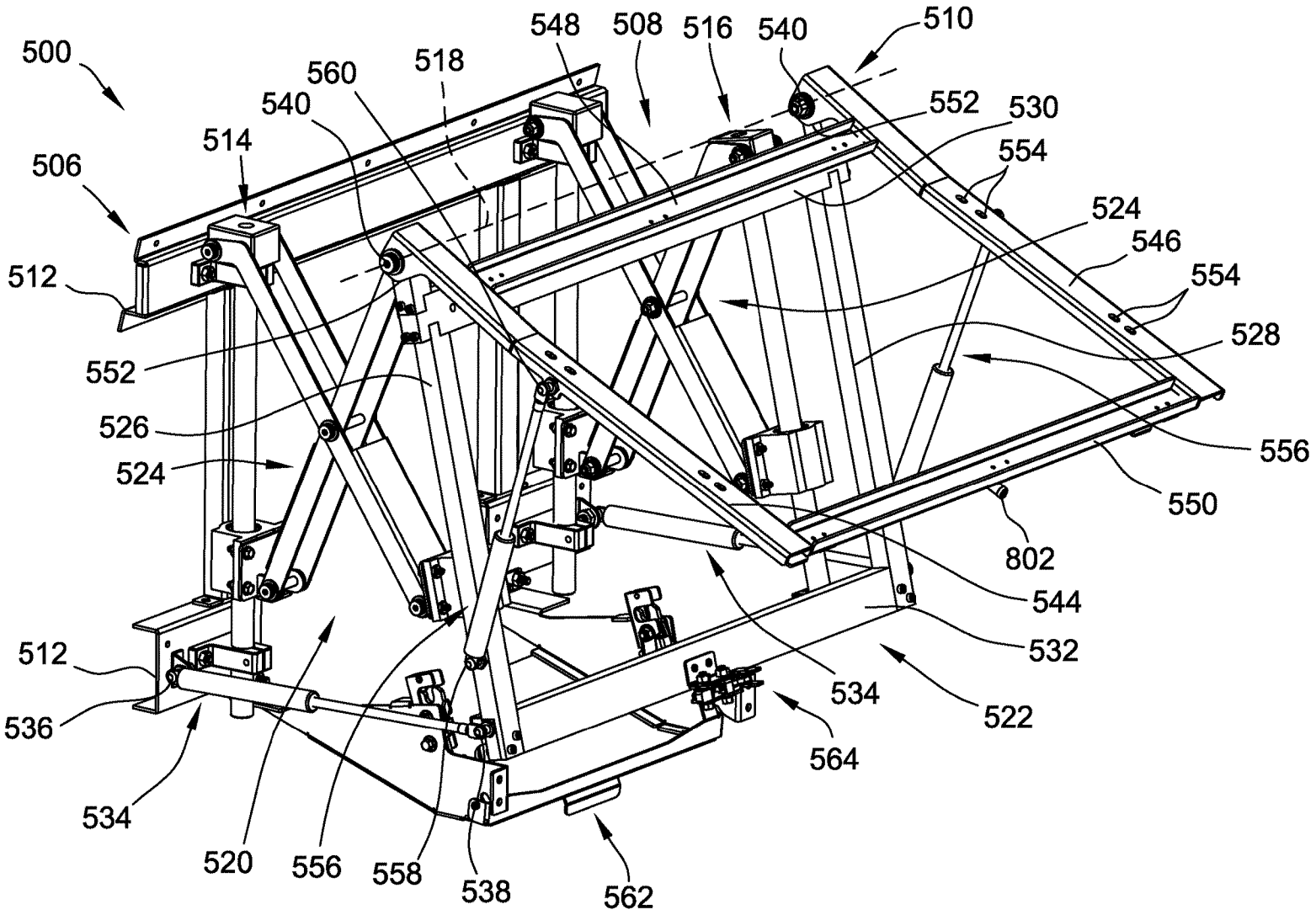
FIG. 9 is a perspective view of the monitor articulation mechanism shown in FIG. 5, illustrated in the third, open position.

With additional reference to FIG. 9, mounting frame assembly 506 includes a plurality of mounting brackets 512 that are fixedly coupled to cabinet 402. Mounting brackets 512 are tubular U-shaped brackets in the illustrated embodiment, although it should be understood that mounting brackets 512 may have any other suitable construction that enables articulating support frame 500 to function as described herein.

Articulating support frame 500 is fixedly coupled to cabinet 402 by mounting frame assembly 506. In particular, linear guide 508 has a first, proximal end 514 fixedly coupled to the cabinet 402 by mounting frame assembly 506. Linear guide 508 also has a second, distal end 516 configured for linear movement towards and away from proximal end 514 along a linear path of motion. As described further herein, linear guide 508 is moveable between a first, retracted position (shown in FIGS. 5 and 6) to a second, extended position (shown in FIG. 7) in which distal end 516 is moved linearly away from proximal end 514.

The terms proximal and distal when used with reference to articulating support frame 500 refer to the relative location or position of elements with respect to the fixed or proximal end of articulating support frame 500 (i.e., at mounting frame assembly 506) and the moving or distal end of articulating support frame 500. For example, "proximal" may refer to a location or position of an element closer to the fixed end of articulating support frame 500, whereas "distal" may refer to a location or position of an element that is further from the fixed end of articulating support frame 500 and closer to the moveable end of articulating support frame 500.

Monitor mounting frame 510 is pivotably coupled to linear guide 508 at distal end 516 thereof, and is configured to rotate about a pivot axis 518 at which monitor mounting frame 510 is pivotably coupled to linear guide 508. Monitor mounting frame 510 is also configured to move linearly as linear guide 508 moves between the retracted and extended positions. First display monitor 404 is coupled to the monitor mounting frame 510, and is configured to move linearly and arcuately with monitor mounting frame 510. In other words, monitor mounting frame 510 moves along first, linear path of motion 502 from the first, closed position (shown in FIGS. 4-6) to the second, intermediate position (shown in FIG. 7), and along second, arcuate path of motion 504 from the second position to the third, open position (shown in FIG. 8).

As shown in FIG. 9, in the exemplary embodiment, linear guide 508 includes a scissor support frame 520 and a sub-frame 522 coupled at distal end 516 of linear guide 508. Scissor support frame 520 is operable to move sub-frame 522 along first, linear path of motion 502 as scissor support frame 520 moves from the retracted position (shown in FIGS. 5 and 6) to the extended position (shown in FIGS. 7-9).

Figure 10:
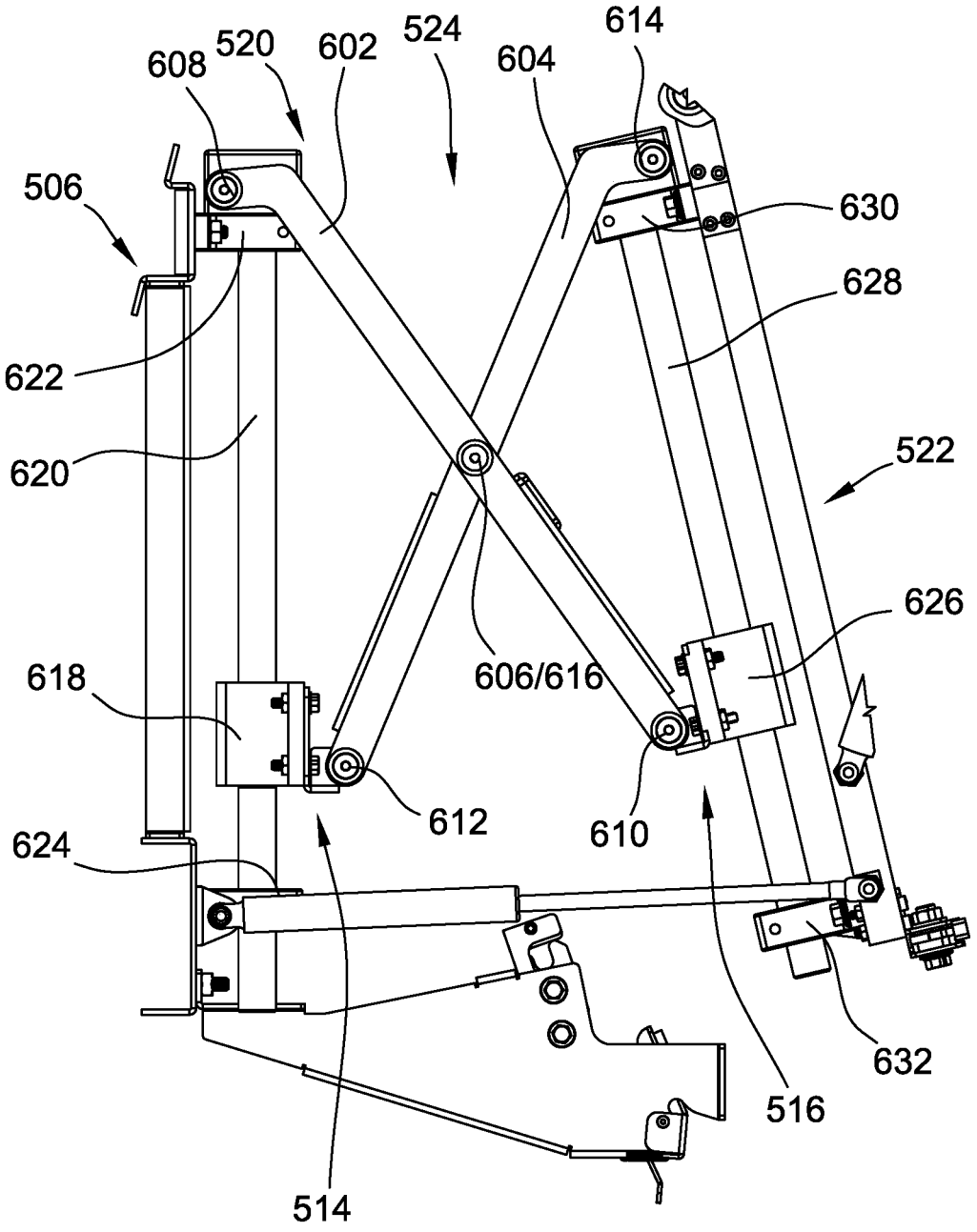
FIG. 10 is a side view of a linear guide of the monitor articulation mechanism shown in FIG. 5.

Scissor support frame 520 includes a plurality of cross-link assemblies 524. With additional reference to FIG. 10, each cross-link assembly 524 includes first and second frame members 602, 604 pivotably coupled to one another at a pivot point 606. Each first frame member 602 extends from a first, proximal end 608, to a second, distal end 610. Similarly, each second frame member 604 extends from a first, proximal end 612, to a second, distal end 614. Each first frame member 602 is pivotably coupled to a respective one of the second frame members 604 by a pivot pin 616 at a location in between the respective proximal and distal ends of each first frame member 602 and second frame member 604 such that the first and second frame members 602, 604 can rotate relative to one another.

First end 612 of each second frame member 604 is pivotably coupled to a respective first linear slider bearing 618 at proximal end 514 of linear guide 508. Each first linear slider bearing 618 is slidably coupled to a first, proximal shaft or rod 620 at proximal end 514 of linear guide 508, which is fixedly coupled to mounting frame assembly 506 by first and second proximal shaft supports 622, 624. As shown, for example, in FIG. 7, first linear slider bearing 618 allows first end 612 of each second frame member 604 to move linearly in a direction parallel to first shaft 620 as scissor support frame 520 moves between the retracted position and the extended position.

First end 608 of each first frame member 602 is pivotably coupled to one of first proximal shaft supports 622 at proximal end 514 of linear guide 508. Second end 610 of each first frame member 602 is pivotably coupled to a respective second linear slider bearing 626 at distal end 516 of linear guide 508. Each second linear slider bearing 626 is slidably coupled to a second, distal shaft or rod 628 at distal end 516 of linear guide 508, which is coupled to sub-frame 522 by first and second distal shaft supports 630, 632. As shown, for example, in FIG. 7, second linear slider bearing 626 allows second end 610 of each first frame member 602 to move linearly in a direction parallel to second shaft 628 as scissor support frame 520 moves between the retracted position and the extended position.

Second end 614 of each second frame member 604 is pivotably coupled to one of first distal shaft supports 630 at distal end 516 of linear guide 508 such that second frame member 604 may rotate relative to first distal shaft support 630 as scissor support frame 520 moves between the retracted position and the extended position.

Referring again to FIG. 9, sub-frame 522 is coupled to each of the plurality of cross-link assemblies 524 at distal end 516 of linear guide 508, and is configured to move linearly along first path of motion 502 when linear guide 508 moves from the retracted position to the extended position. For example, when a distal force is applied to first display monitor 404 (e.g., by an operator pulling on first display monitor 404), rotation of the first and second frame members 602, 604 of each cross-link assembly 524 about pivot point 606 permits linear motion of sub-frame 522, thereby allowing first display monitor 404 to move along first path of motion 502.

In the exemplary embodiment, sub-frame 522 has a substantially rectangular configuration, and includes a first side member 526, a second side member 528, and first and second cross-members 530, 532 extending from first side member 526 to second side member 528. Sub-frame 522 is fixedly coupled to first and second distal shaft supports 630, 632 of each cross-link assembly 524 such that sub-frame 522 moves with first and second distal shaft supports 630, 632 as linear guide 508 moves from the retracted position to the extended position. In the exemplary embodiment, first distal shaft supports 630 are coupled to first cross member 530, and second distal shaft supports 632 are coupled to second cross member 532. In other embodiments, first and second distal shaft supports 630, 632 may be coupled to any suitable portion of sub-frame 522 that enables articulating support frame to function as described herein.

Although linear guide 508 is described and shown herein as including a scissor support frame, it should be understood that linear guide 508 is not limited to a scissor support frame, and may have any other suitable construction that enables linear guide 508 to function as described herein. In other embodiments, for example, linear guide 508 may include linear slides, rails, rollers, rods, linear actuators, and any suitable combinations thereof that enable linear guide 508 to impart linear motion to monitor mounting frame 510.

Linear guide 508 may also include one or more actuators or biasing elements to facilitate movement of sub-frame 522 and, in turn, monitor mounting frame 510 along first path of motion 502 towards the second position (shown in FIG. 7). In the illustrated embodiment, for example, linear guide 508 includes first biasing elements 534 configured to bias sub-frame 522 and monitor mounting frame 510 towards the second position (shown in FIG. 7). The illustrated embodiment includes two first biasing elements 534, although other embodiments may include more than or less than two first biasing elements 534. First biasing elements 534 can generally comprise any suitable biasing element that enables articulating support frame 500 to function as described herein, including, for example and without limitation, gas springs (also known as gas struts and gas shocks), mechanical springs (e.g., coil springs), pneumatic pistons, hydraulic pistons, screws, linear gear systems, and combinations thereof. In the exemplary embodiment, first biasing elements 534 are gas springs having a first end 536 coupled to mounting frame assembly 506, and a second, opposite end 538 coupled to sub-frame 522. In the exemplary embodiment, first biasing elements 534 are positioned on opposite sides of sub-frame 522, although in other embodiments first biasing elements 534 may be located at any suitable position that enables linear guide 508 to function as described herein.

Linear guide 508 is configured to move sub-frame 522, monitor mounting frame 510, and first display monitor 404 by a linear distance sufficient for first display monitor 404 to be moved completely out of access opening 428 and clear of (and therefore not interfere with or be obstructed by) second display monitor 406. In the exemplary embodiment, linear guide 508 is configured to linearly move sub-frame 522, monitor mounting frame 510, and first display monitor 404 by a distance of at least 10 mm, at least 20 mm, at least 30 mm, at least 40 mm, at least 50 mm, at least 75 mm, at least 90 mm, at least 100 mm, at least 110 mm, at least 120 mm, at least 150 mm, at least 200 mm, at least 250 mm, at least 300 mm, at least 350 mm, at least 400 mm, and up to 550 mm. In other embodiments, linear guide 508 may be configured to linearly move sub-frame 522, monitor mounting frame 510, and first display monitor 404 by a distance less than 10 mm, or more than 550 mm.

Monitor mounting frame 510 is pivotably coupled to sub-frame 522 at pivot axis 518 via one or more pivot pins 540. Pivot pins 540 may include any suitable bearing components that enable monitor mounting frame 510 to rotate about pivot axis 518 with respect to sub-frame 522, as described herein. As shown in FIG. 8, monitor mounting frame 510 and, in turn, first display monitor 404 are configured to rotate upward and away from sub-frame 522 when monitor mounting frame 510 moves along second path of motion 504 from the second position to the third, open position. In other embodiments, monitor mounting frame 510 and first display monitor 404 may rotate in any suitable direction with respect to sub-frame 522.

Monitor mounting frame 510 and, in turn, first display monitor 404, are configured to rotate by a sufficient amount to allow an operator or service technician to access internal compartment 426 of gaming machine 400 via access opening 428 (shown in FIG. 4). In the exemplary embodiment, monitor mounting frame 510 and, in turn, first display monitor 404, are configured to rotate by an angle 542 of about 60° from the second position to the third position. In other embodiments, monitor mounting frame 510 and first display monitor 404 may rotate by any suitable angle that enables the articulating support frame 500 to function as described herein. In other embodiments, for example, monitor mounting frame 510 and first display monitor 404 may rotate by an angle 542 of between 20° and 270°, between 40° and 190°, between 40° and 140°, between 80° and 180°, between 45° and 135°, between 60° and 150°, between 90° and 180°, between 60° and 120°, between 90° and 150°, between 120° and 180°, between 75° and 105°, between 90° and 120°, and between 105° and 135°.

Referring again to FIG. 9, monitor mounting frame 510 has a substantially rectangular configuration in the exemplary embodiment, and includes a first side member 544, a second side member 546, and first and second cross members 548, 550. First and second side members 544, 546 each include mounting ears or tabs 552 for receiving pivot pins 540 to pivotably couple monitor mounting frame 510 to sub-frame 522. First side member 544 of monitor mounting frame 510 is pivotably coupled to first side member 526 of sub-frame 522 at the top thereof, and second side member 546 of monitor mounting frame 510 is pivotably coupled to second side member 528 of sub-frame 522 at the top thereof. In other embodiments, monitor mounting frame 510 may be coupled to sub-frame 522 at any suitable location(s) that enables the articulating support frame to function as described herein.

First display monitor 404 is coupled to monitor mounting frame 510 using any suitable fasteners that enable the articulating support frame 500 to function as described herein. In some embodiments, first display monitor 404 is coupled to monitor mounting frame 510 via slotted fasteners (e.g., pins, bolts, etc.) received in key holes 554 defined in monitor mounting frame 510 (specifically, in first and second side members 544, 546) such that first display monitor 404 can be de-coupled and removed from monitor mounting frame 510 by sliding first display monitor 404 relative to monitor mounting frame 510. In one exemplary embodiment, first display monitor 404 includes a plurality of studs or shoulder washers protruding from a rear surface thereof, and each of the shoulder washers is received in a corresponding key hole 554 defined in monitor mounting frame 510.

Articulating support frame 500 may also include one or more actuators or biasing elements to facilitate rotation of monitor mounting frame 510 and, in turn, first display monitor 404 along second path of motion 504 towards the third position (shown in FIG. 8). In the illustrated embodiment, for example, articulating support frame 500 includes second biasing elements 556 configured to bias monitor mounting frame 510 and first display monitor 404 towards the third position (shown in FIG. 8).

Additionally, in the exemplary embodiment, second biasing elements 556 are configured to resist or inhibit rotational motion of monitor mounting frame 510 and first display monitor 404 from the third position to the second position under the weight of the first display monitor 404. For example, the biasing force (e.g., spring constant, pressure, etc.) of second biasing elements 556 is selected to withstand the combined weight of monitor mounting frame 510 and first display monitor 404 such that monitor mounting frame 510 and first display monitor 404 will not rotate from the third position to the second position without an external applied force. The second biasing elements 556 thereby reduce the risk of the articulating support frame 500 unintentionally closing, for example, while gaming machine 400 is being serviced.

The illustrated embodiment includes two second biasing elements 556, although other embodiments may include more than or less than two second biasing elements 556. Second biasing elements 556 can generally comprise any suitable biasing element that enables articulating support frame 500 to function as described herein, including, for example and without limitation, gas springs, mechanical springs (e.g., coil springs), pneumatic pistons, hydraulic pistons, screws, linear gear systems, and combinations thereof. In the exemplary embodiment, second biasing elements 556 are gas springs having a first end 558 coupled to sub-frame 522, and a second, opposite end 560 coupled to monitor mounting frame 510. In the exemplary embodiment, second biasing elements 556 are positioned on opposite sides of monitor mounting frame 510 and sub-frame 522, although in other embodiments second biasing elements 556 may be located at any suitable position that enables linear guide 508 to function as described herein. Further, in the illustrated embodiment, second biasing elements 556 have the same configuration as first biasing elements 534. In other embodiments, second biasing elements 556 may have a different configuration than first biasing elements 534.

Articulating support frame 500 may also include one or more locks or latches to control motion of first display monitor 404 along first path of motion 502 and second path of motion 504. As shown in FIG. 9, for example, articulating support frame 500 includes a linear motion latch 562 and a rotational motion latch 564. Linear motion latch 562 is configured to prevent linear motion of first display monitor 404 along first path of motion 502 when linear motion latch 562 is in a latched state, and rotational motion latch 564 is configured to prevent rotational motion of first display monitor 404 along second path of motion 504 when rotational motion latch 564 is in a latched state. When linear motion latch 562 is released from the latched state, first biasing elements 534 move or urge sub-frame 522, monitor mounting frame 510, and first display monitor 404 linearly along first path of motion 502 from the first position to the second position. When rotational motion latch 564 is released from the latched state, second biasing elements 556 move or urge monitor mounting frame 510 and first display monitor 404 rotationally along second path of motion 504 from the second position to the third position. In the exemplary embodiment, linear motion latch 562 and rotational motion latch 564 operate independently of one another. For example, linear motion latch 562 is configured to be released prior to rotational motion latch 564 such that first display monitor 404 may be moved linearly along first path of motion 502 and out of access opening 428 before rotational motion latch 564 is released. Moreover, in the exemplary embodiment, rotational motion latch 564 is inaccessible when first display monitor 404 is in the first position. In other words, rotational motion latch 564 cannot be accessed prior to first display monitor 404 being moved from the first position to the second position. Having rotational motion latch 564 inaccessible when first display monitor 404 is in the first position reduces the risk of inadvertent or mistaken rotation of first display monitor 404 while in the first position, which may otherwise cause damage to first display monitor 404 or surrounding components. In other embodiments, articulating support frame 500 may include a dual-function latch that operates to restrict both linear and rotational motion of first display monitor 404.

Figure 11:
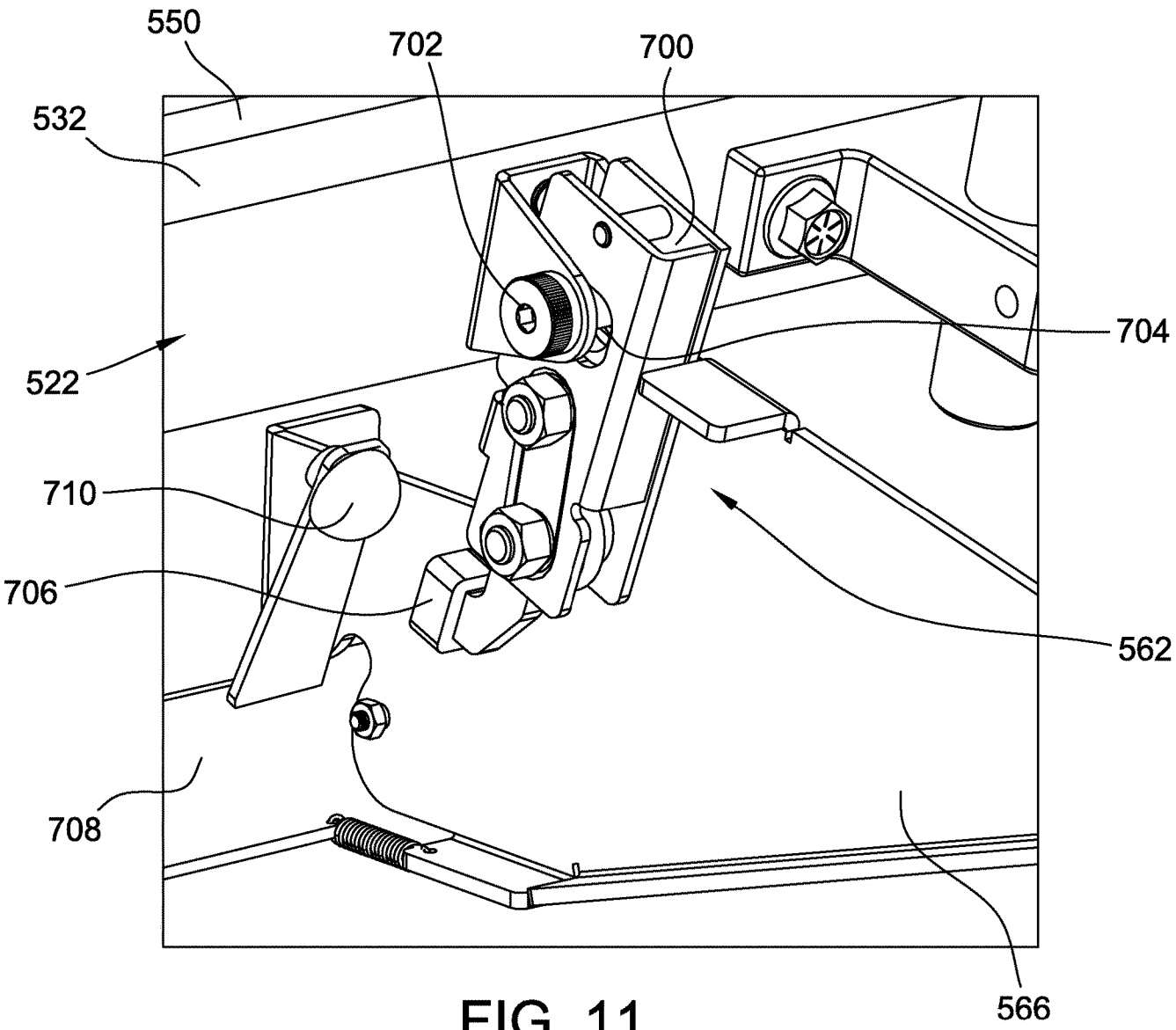
FIG. 11 is an enlarged perspective view of a linear motion latch of the monitor articulation mechanism shown in FIG. 5
Figure 12:
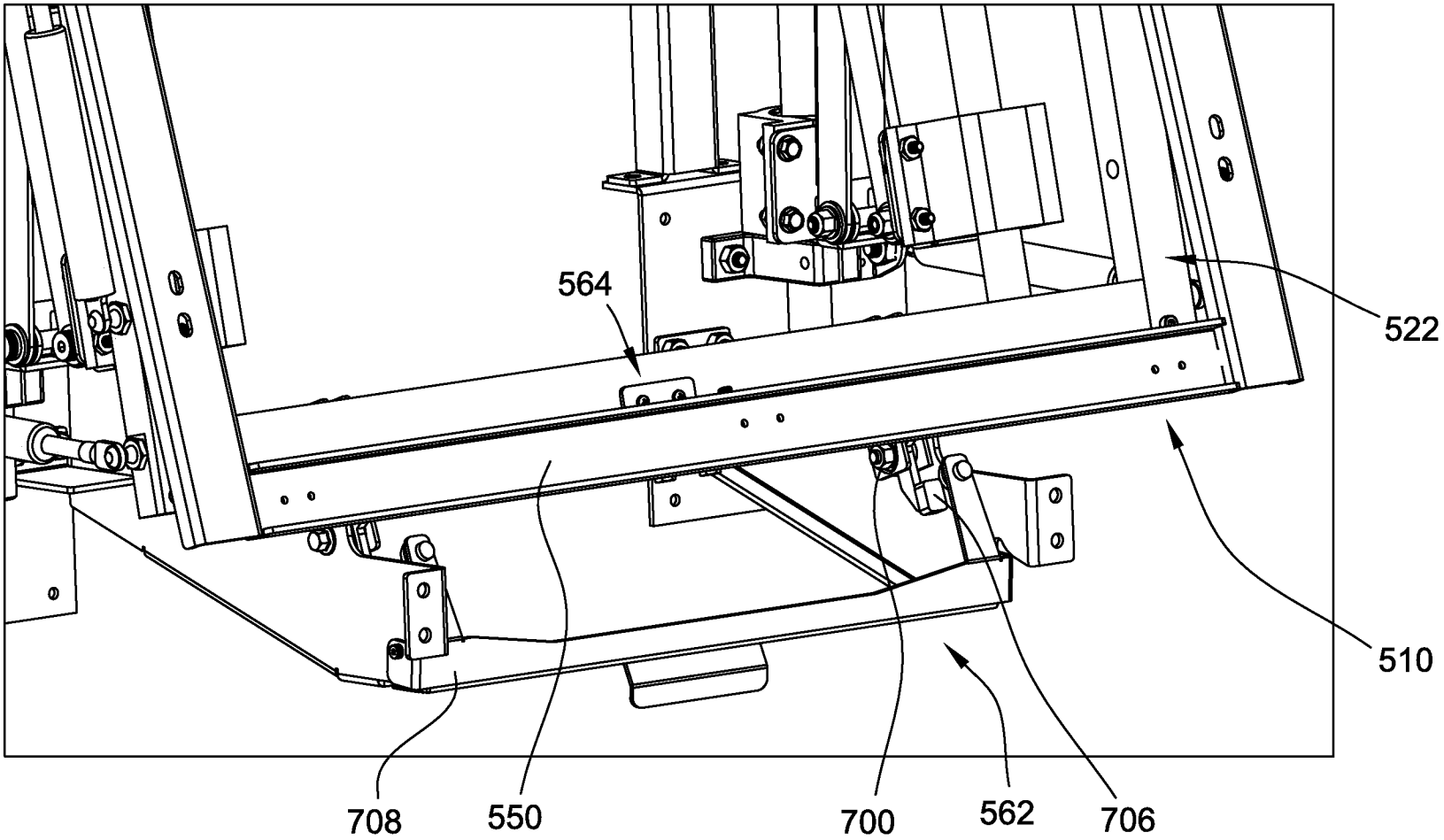
FIG. 12 is another perspective view of the monitor articulation mechanism shown in FIG. 5, illustrating additional details of the linear motion latch shown in FIG. 11.
Figure 13:
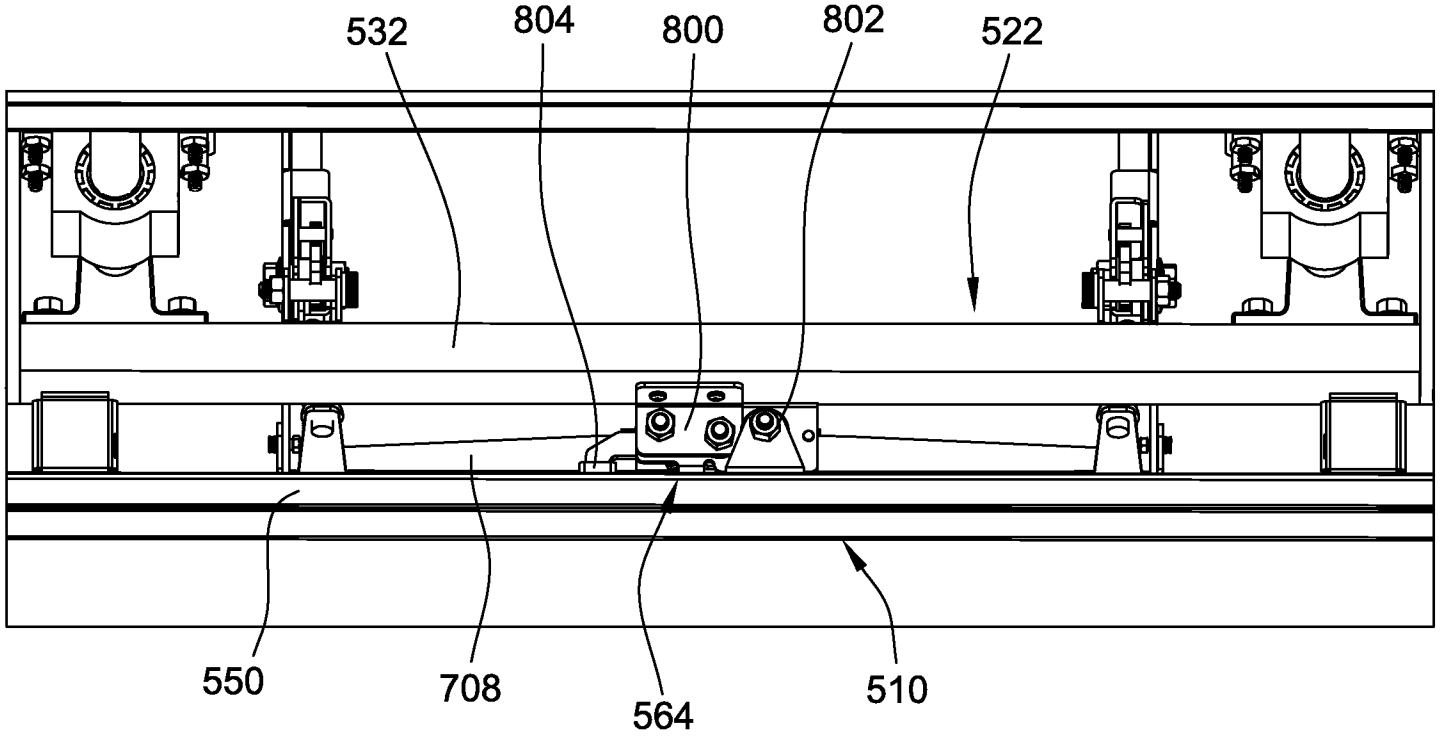
FIG. 13 is a top view of a portion of the monitor articulation mechanism shown in FIG. 5, illustrating details of a rotational motion latch.

Linear motion latch 562 and rotational motion latch 564 may generally comprise any suitable latch mechanisms that enable the articulating support frame 500 to function as described herein. In the exemplary embodiment, each of linear motion latch 562 and rotational motion latch 564 includes a rotary latch, details of which are shown in FIGS. 11-13. More specifically, with additional reference to FIGS. 11-12, linear motion latch 562 includes a pair of identical rotary latches 700 coupled to respective support brackets 566 of mounting frame assembly 506. A linear motion latch pin 702 fixedly coupled to sub-frame 522 is received within a slot 704 defined by each rotary latch 700, and is restricted from movement when rotary latch 700 is in the latched state. Rotary latch 700 includes a release button 706 that, when depressed, actuates internal components of rotary latch 700 to release linear motion latch pin 702 from rotary latch 700. Linear motion latch 562 also includes a latch handle 708 (also shown in FIG. 12) that includes bumpers 710 for engaging release button 706 of rotary latch 700. Latch handle 708 is moveable from a first position (shown in FIGS. 10 and 11) in which bumpers 710 are spaced apart from release button 706 to a second position (not shown) in which bumpers 710 engage release button 706 and thereby disengage rotary latch 700, permitting movement of linear motion latch pin 702 out of slot 704 and linear motion of sub-frame 522 and components connected thereto.

With additional reference to FIG. 13, rotational motion latch 564 includes a rotary latch 800 having the same configuration as rotary latches 700 of linear motion latch 562. Specifically, as shown in FIG. 13, rotary latch 800 is fixedly coupled to sub-frame 522, and defines a slot (not shown) that receives a rotational motion latch pin 802 (also shown in FIG. 9) fixedly coupled to monitor mounting frame 510. Rotational motion latch pin 802 is restricted from movement when rotary latch 800 is in the latched state. A release button 804 of rotary latch is accessible by an operator by hand, for example, by reaching underneath and behind second cross member 550 of monitor mounting frame 510. When release button 804 is engaged, rotary latch 800 is disengaged and permits movement of rotational motion latch pin 802 out of the slot and, in turn, rotational motion of monitor mounting frame 510 and first display monitor 404. In the exemplary embodiment, when rotational motion latch 564 is released, second biasing elements 556 move monitor mounting frame 510 and first display monitor 404 along the second path of motion 504 to the third position.

The configuration of articulating support frame 500 allows first display monitor 404 to be moved out of access opening 428 without interfering with or being obstructed by surrounding components of gaming machine 400. In particular, articulating support frame 500 is configured to move first display monitor 404 along first, linear path of motion 502 such that first display monitor 404 is moved completely out of access opening 428 without interfering with or being obstructed by second display monitor 406 or light bars. Articulating support frame 500 is further configured to move first display monitor 404 along second, arcuate path of motion 504 such that first display monitor 404 is rotated out of the way of and permits access to access opening 428. Moreover, articulating support frame 500 does not require certain biasing elements commonly used in other door hinge assemblies, such as torsion springs or counter-weights. That is, articulating support frame 500 is free of counter-weights and torsion springs.

In operation, to move first display monitor 404 out of access opening 428 to access internal compartment 426 of gaming machine 400, linear motion latch 562 is initially released or disengaged by actuating or pulling latch handle 708. Pulling latch handle 708 causes bumpers 710 to engage release button 706 of rotary latches 700, thereby releasing linear motion latch pin 702 and allowing linear guide 508 to move from the retracted position (shown in FIGS. 5 and 6) to the extended position (shown in FIGS. 7-9). Once linear motion latch 562 is released, first biasing elements 534 urge or move sub-frame 522, monitor mounting frame 510, and first display monitor 404 along first path of motion 502 from the first position (shown in FIGS. 5 and 6) to the second position (shown in FIG. 7). In embodiments where first biasing elements 534 do not move sub-frame 522, monitor mounting frame 510, and first display monitor 404 automatically, an external force (e.g., an operator pulling on first display monitor 404) may be applied to first display monitor 404 or other components of articulating support frame 500 to effect movement of first display monitor 404 along first path of motion 502. As first display monitor 404 moves from the first position to the second position along first path of motion 502, articulating support frame 500 inhibits rotation of first display monitor 404 to avoid contact or interference with adjacent components of gaming machine 400 (e.g., second display monitor 406 and light bars 420).

After first display monitor 404 is moved to the second position and is clear of second display monitor 406 and light bars 420, rotational motion latch 564 is released by depressing release button 804 of rotary latch 800. Depressing release button 804 of rotary latch 800 releases rotational motion latch pin 802, thereby allowing monitor mounting frame 510 and first display monitor 404 to rotate along second path of motion 504 from the second position to the third position (shown in FIG. 8). Once rotational motion latch 564 is released, second biasing elements 556 urge or move monitor mounting frame 510 and first display monitor 404 along second path of motion 504 from the second position (shown in FIG. 7) to the third position (shown in FIG. 8). In embodiments where second biasing elements 556 do not move monitor mounting frame 510 and first display monitor 404 automatically, an external force (e.g., an operator pulling on first display monitor 404) may be applied to first display monitor 404 or other components of articulating support frame 500 to effect movement of first display monitor 404 along second path of motion 504.

In some embodiments, first display monitor 404 may be removed from articulating support frame 500, for example, after first display monitor 404 is moved to the third position. In such embodiments, first display monitor 404 may be decoupled from monitor mounting frame 510 by sliding first display monitor 404 relative to monitor mounting frame 510 to disengage slotted fasteners, and subsequently removing first display monitor 404 from monitor mounting frame.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine comprising:

a cabinet defining an internal compartment and an access opening that provides access to the internal compartment;

a monitor positioned within the access opening; and an articulating support frame positioned within the internal compartment and operatively coupled to the monitor, wherein the monitor is moveable by the articulating support frame along a first, linear path of motion from a first, closed position to a second, intermediate position, and along a second, arcuate path of motion from the second position to a third, open position.

2. The electronic gaming machine of claim 1, wherein the articulating support frame inhibits rotation of the monitor as the monitor is moved from the first, closed position to the second, intermediate position.

3. The electronic gaming machine of claim 1, wherein the monitor is moved completely out of the access opening when moved from the first position to the second position.

4. The electronic gaming machine of claim 1, wherein the articulating support frame comprises:

a linear guide having a proximal end fixedly coupled to the cabinet, and a distal end configured for linear movement towards and away from the proximal end; and a monitor mounting frame pivotably coupled to the linear guide at the distal end thereof, the monitor coupled to the monitor mounting frame.

5. The electronic gaming machine of claim 4, wherein the linear guide comprises:

a scissor support frame comprising a plurality of cross-link assemblies, each cross-link assembly comprising first and second frame members pivotably coupled to one another at a pivot point;

a sub-frame coupled to each of the plurality of cross-link assemblies at the distal end of the linear guide, wherein rotation of the first and second frame members of each cross-link assembly about the pivot point permits linear motion of the sub-frame; and at least one biasing element coupled to the sub-frame and configured to bias the sub-frame towards second position.

6. The electronic gaming machine of claim 5, wherein the articulating support frame further comprises a latch coupled to the sub-frame and configured to inhibit linear motion of the sub-frame in a latched state, wherein when the latch is released, the at least one biasing element moves the sub-frame along the first path of motion.

7. The electronic gaming machine of claim 4, wherein the articulating support frame further comprises at least one biasing element operatively coupled to the monitor mounting frame and configured to bias the monitor mounting frame towards the third position.

8. The electronic gaming machine of claim 7, wherein the articulating support frame further comprises a latch coupled to the linear guide and configured to inhibit rotation of the monitor mounting frame in a latched state, wherein when the latch is released, the at least one biasing element moves the monitor mounting frame along the second path of motion.

9. The electronic gaming machine of claim 4, wherein the monitor is removably coupled to the monitor mounting frame by slotted fasteners such that the monitor can be de-coupled from the monitor mounting frame by sliding the monitor relative to the monitor mounting frame.

10. The electronic gaming machine of claim 1, further comprising a mounting frame assembly, wherein the articulating support frame is fixedly coupled to the cabinet by the mounting frame assembly.

11. The electronic gaming machine of claim 1, wherein the monitor is a first monitor, the electronic gaming machine further comprising a second monitor positioned adjacent the first monitor.

12. The electronic gaming machine of claim 11, wherein the first and second monitors cooperatively form a curved display screen, wherein the first and second monitors adjoin one another along an edge that intersects the curved display screen.

13. The electronic gaming machine of claim 1, wherein the articulating support frame is free of counter-weights.

14. The electronic gaming machine of claim 1, wherein the articulating support frame is free of torsion springs.

15. A method comprising:

providing an electronic gaming machine including a cabinet defining an internal compartment and an access opening, a monitor positioned within the access opening, and an articulating support frame positioned within the internal compartment and operatively coupled to the monitor;

moving the monitor, by the articulating support frame, along a first, linear path of motion from a first, closed position to a second, intermediate position; and moving the monitor, by the articulating support frame, along a second, arcuate path of motion from the second position to a third, open position in which the monitor permits access to the internal compartment through the access opening.

16. The method of claim 15 further comprising inhibiting rotation of the monitor as the monitor is moved along the first, linear path of motion.

17. The method of claim 15, further comprising removing the monitor from the articulating support frame subsequent to the monitor being moved to the third position.

18. An articulating support frame for a monitor of an electronic gaming machine, the articulating support frame comprising:

a linear guide having a proximal end configured for fixedly coupling to a cabinet of the electronic gaming machine, and a distal end configured for linear movement towards and away from the proximal end; and a monitor mounting frame pivotably coupled to the linear guide at the distal end thereof;

wherein the articulating support frame is configured to move the monitor along a first, linear path of motion from a first, closed position to a second, intermediate position, and along a second, arcuate path of motion from the second position to a third, open position.

19. The articulating support frame of claim 18, wherein the linear guide comprises:

a scissor support frame comprising a plurality of cross-link assemblies, each cross-link assembly comprising first and second frame members pivotably coupled to one another at a pivot point;

a sub-frame coupled to each of the plurality of cross-link assemblies at the distal end of the linear guide, wherein rotation of the first and second frame members of each cross-link assembly about the pivot point permits linear motion of the sub-frame; and at least one first biasing element coupled to the sub-frame and configured to bias the sub-frame towards second position.

20. The articulating support frame of claim 19, further comprising at least one second biasing element operatively coupled to the monitor mounting frame and configured to bias the monitor mounting frame towards the third position.

* * * * *